United States Patent [19]

Jacobs

[11] 4,059,975

[45] Nov. 29, 1977

[54] BELT-DRIVEN TRANSFER ARM CLUTCH MECHANISM FOR AGITATOR WASHER

[75] Inventor: James W. Jacobs, Dayton, Ohio

[73] Assignee: General Motors Corporation, Detroit, Mich.

[21] Appl. No.: 745,576

[22] Filed: Nov. 29, 1976

[51] Int. Cl.[2] ..... D06F 13/02; D06F 37/40

[52] U.S. Cl. ..... 68/23.7; 68/133; 192/51

[58] Field of Search ..... 68/23.6, 23.7, 133; 192/51

[56] References Cited

U.S. PATENT DOCUMENTS

| | | | |
|---|---|---|---|
| 1,170,653 | 2/1916 | Marette | 192/51 |
| 2,064,075 | 12/1936 | McPherson | 192/51 X |
| 2,385,734 | 9/1945 | Silva et al. | 192/51 |
| 2,610,498 | 9/1952 | Geldhof et al. | 68/23.7 |
| 2,974,542 | 3/1961 | Sisson et al. | 68/23.7 X |
| 3,563,353 | 2/1971 | LoPresti et al. | 192/51 X |
| 3,675,748 | 7/1972 | Hansen | 192/51 |

*Primary Examiner*—Philip R. Coe

*Attorney, Agent, or Firm*—Edward P. Barthel

[57] ABSTRACT

A domestic clothes washer drive mechanism for oscillating an agitator in a nested pair of tubs wherein the inner tub is selectively rotatable by said mechanism and the outer tub is generally fixed against rotation and adapted to contain water. A pair of vertically spaced pulleys driven by a reversible motor and a single belt are rotatably mounted with concentric agitate and spin drive shafts related therewith. A radial transfer follower arm is pivotally secured to the agitator shaft intermediate the driven pulleys. The pulleys have opposed drive notches configured so that in one direction of motor rotation one pulley notch is operative to engage the arm and rotate the agitator shaft in a first direction through a predetermined arc, after which the opposed pulley notch is rotated into position and the arm escapes the one notch and is engaged by the opposed notch causing the agitator shaft to be driven in an oscillatable manner. Upon the motor and driven pulleys being operated in the opposite direction of rotation the follower arm is captured in a pulley notch and causes the spin shaft and tub to rotate.

3 Claims, 9 Drawing Figures

BELT-DRIVEN TRANSFER ARM CLUTCH MECHANISM FOR AGITATOR WASHER

This invention relates to a domestic appliance and more particularly to a novel agitating and spinning drive mechanism for a clothes washer.

In prior clothes washing art, wherein drive mechanisms have been provided for forming the agitation and spin operation in laundry machines, it has been common practice to convert the rotary motion of a driving source to an oscillating drive for an agitator by means of a suitable gear and crank drive system. Such gear and crank drive systems are not only expensive to manufacture but require enclosure in a housing with lubricating oil contained therein. As discussed in the inventor's co-pending U.S. Patent application Ser. No. 697,942, filed June 21, 1976, these gear and crank drive systems are commonly referred to as wet-running systems. The present invention involves an agitator and spin drive mechanism for a laundry machine consisting of a pair of driven pulleys opposed portions of which are formed with notches which together with a radial transfer arm pivotally secured to the agitator shaft intermediate the pulleys functions as a reversible clutch arrangement which substantially reduces manufacturing costs while providing a substantially dry running system to the extent that it eliminates the requirement of gear lubrication.

Accordingly, it is an object of the present invention to provide a pulley and belt drive laundry machine agitating mechanism wherein opposed portions of a pair of belt driven oppositely rotating pulleys have notches formed therein, a radial transfer arm is pivotally secured to the agitator shaft intermediate the driven pulleys whereby the notches are operative to alternately engage the transfer arm upon the pulleys being rotated through predetermined arcs causing the pulleys to transmit agitation motion to the agitator shaft.

It is another object of the invention to provide an improved clothes washer oscillate and spin drive mechanism for use with nested outer and inner tubs of a domestic clothes washer having concentrically arranged inner agitate and outer spin shaft assemblies, a reversible electric motor having a double-ended drive shaft operably connected to first and second concentrically arranged driven pulleys rotatably carried in fixed respective planes with respect to the agitator and spin tub, drive belt means encircling the driven pulleys and the opposite ends of the motor drive shaft, and reversible clutch means cooperating with the driven pulleys including notches formed on opposed spaced portions of the driven pulleys, the clutch means including a radial transfer arm pivotally secured to the agitator shaft intermediate the driven pulleys for pivotal movement about a horizontal axis, the notches being formed as mirror images of each other to provide cam portions whereby upon being rotated into substantially vertically opposed alignment one pulley notch is operative to engage the transfer arm to effect driving relationship between the drive shaft and the pulley and rotate the agitator shaft in the first direction through a predetermined angular stroke, the clutch means operative upon the other pulley being rotated through the stroke positioning its notch in alignment resulting in the transfer arm being freed from its engaged position with the one pulley notch such that it is free to move therefrom because of its cam portion under the dislodging force of the rotation of the pulley, whereby the arm is pivoted and engaged by the other pulley notch to effect driving relationship therewith rotating the agitator shaft in a reverse direction, and biasing means operative to urge the transfer arm into one of the pulley notches, whereby upon reversal of the drive shaft and belt travel for rotation in a second direction the pulleys will be simultaneously driven in opposite directions of rotation by the drive shaft, whereby the rotation of the driven pulleys in the second direction effecting spin rotation of the tub through the spin shaft and coupling means.

Figure 8:
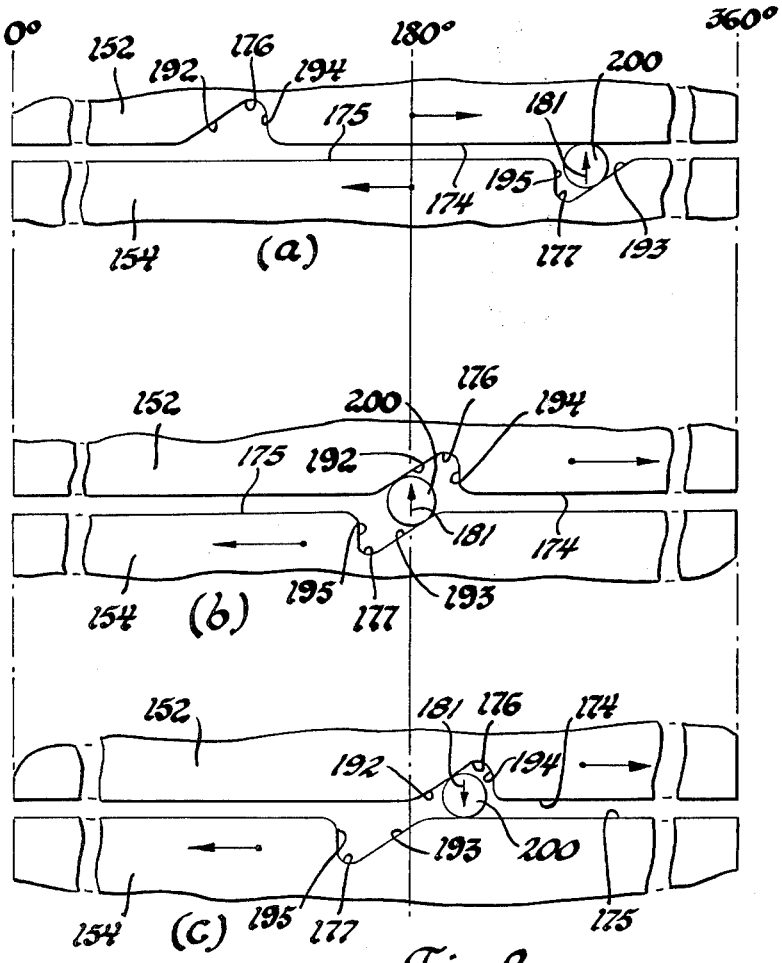
Figure 9:
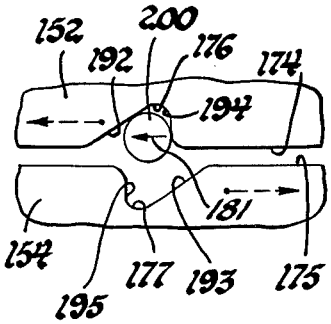

FIG. 8*a, b* and *c* are developed periphery view of the pulleys and transfer arm follower mechanism in various positions of operation; and FIG. 9 is a view similar to FIG. 8, with the transfer arm in its spin mode of operation.

Figure 1:
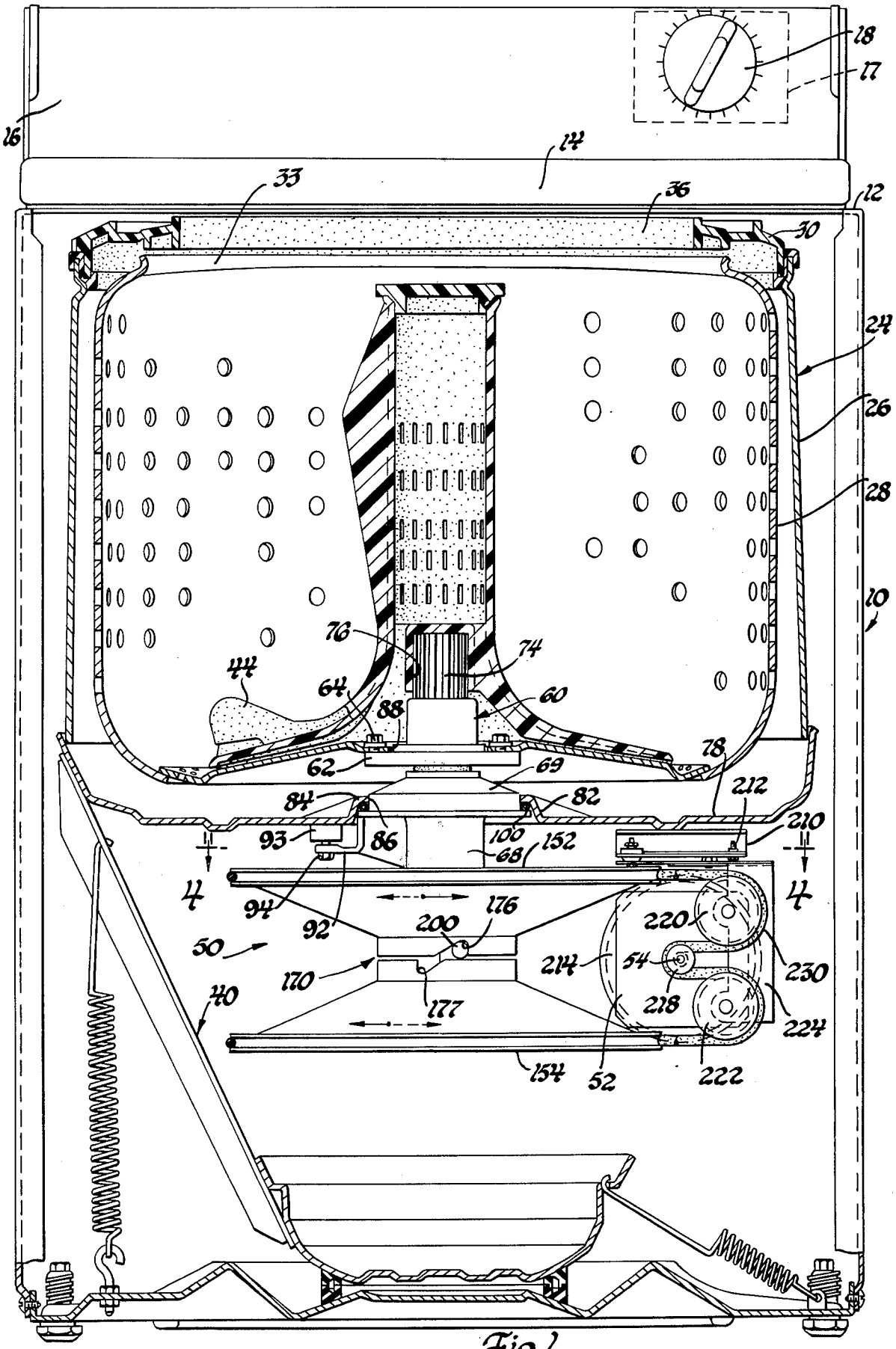
FIG. 1 is a front sectional view of a clothes washing machine, partly in elevation, with parts broken away to show the drive mechanism of the present invention.

As for the environment of this invention and with reference to FIG. 1, a domestic clothes washer is shown generally at 10. The washer includes a box-like sheet metal casing 12 having a top 14. The top has an access opening (not shown) through which clothes are loaded and unloaded. A control panel 16 includes a sequence timer 17 operated by a knob 18.

The casing 12 is shown to close a nested tub assembly indicated generally at 24. The assembly includes an open top imperforate wall water container or outer tub 26 and a perforate wall spin basket or inner tub 28. Perforations are coextensive with the cylindrical side wall of the spin basket 28. An annular plastic subtop 30 is sealingly clamped to the open top of the water container 26. The subtop circumscribes the open top of the water container and extends over a rim 33 froming a top opening of the spin basket 28 to define an access collar 36 between the access opening of the cabinet and the top opening of the spin basket.

The water container 26, and thus the tub assembly 24, is mounted on a suspension system shown generally at 40 and more fully taught in U.S. Pat. No. 3,493,118, issued Feb. 3, 1970. The tub assembly includes an agitator 44 which with the spin basket 28 is connected to a drive mechanism, shown generally at 50. The drive mechanism 50 is operated by a prime mover, such as an electric motor shown in the disclosed form as a four-pole, reversible motor 52, having a double-ended armature shaft 54 which may be selectively operated to oscillate the agitator 44 for washing clothes in the tub assembly and may be operated in another manner wherein the spin basket 28 is rotated with respect to the washer container 26 for centrifuging washing fluid from the clothes in the spin basket.

Figure 2:
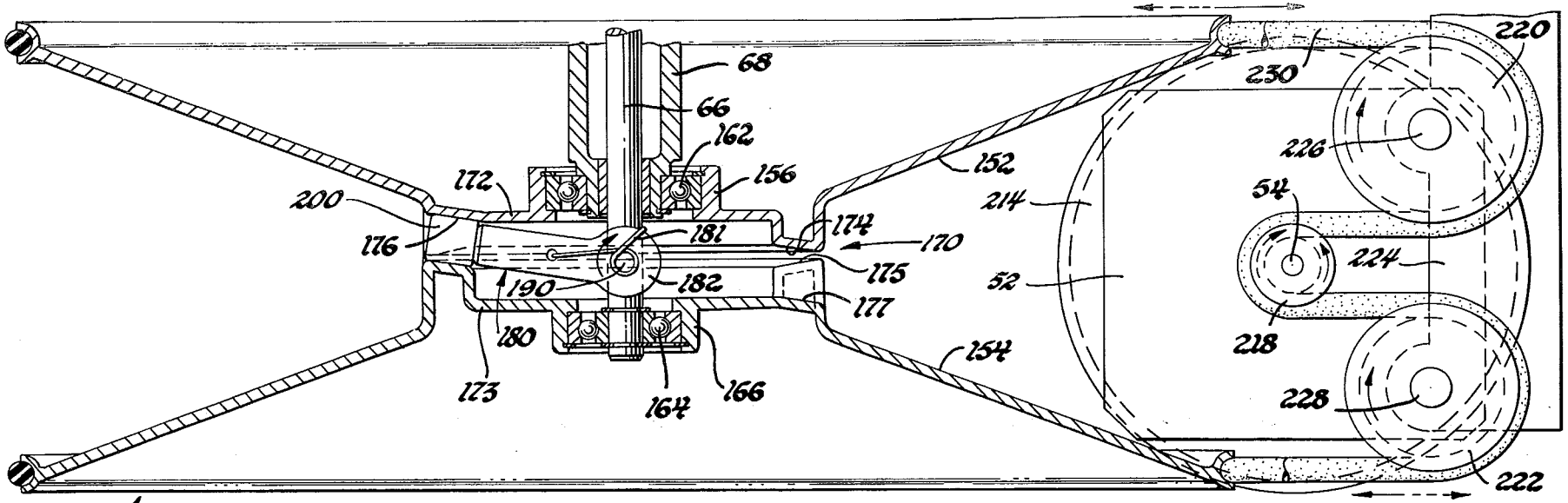
FIG. 2 is an enlarged, fragmentary front sectional view, partly in elevation, of the agitator drive mechanism of FIG. 1.
Figure 3:
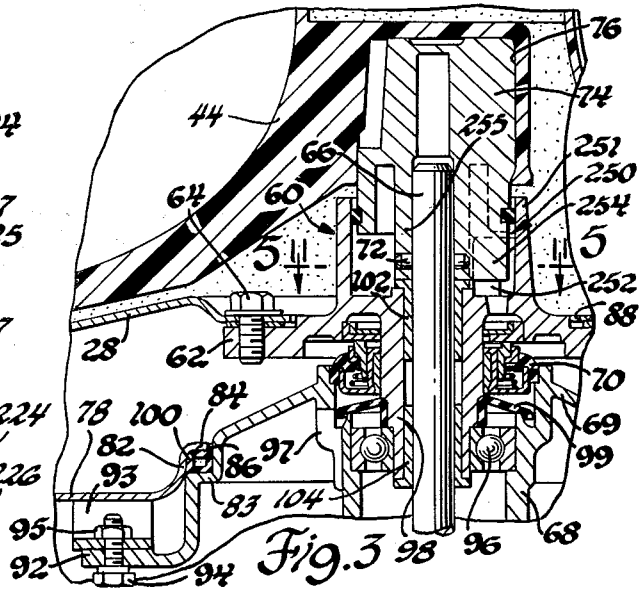
FIG. 3 is an enlarged fragmentary side elevational view of the upper portions of the spin and agitate shafts.

With reference to FIGS. 1–3, relative rotation between the outer tub 26 and inner spin basket 28 is achieved by fastening the bottom wall of the spin basket 28 to spin drive shaft 60 by securing base flange 62 of shaft 60 to basket 28 by means of bolts as at 64. The rotatable spin drive shaft 60 is concentric with inner agitate drive shaft 66. Both shafts 60, 66 extend from, and are enclosed by, a cast housing portion 68 of the mechanism support. Housing 68 includes an attached or integral frustoconical or skirt portion and seal support 69 with seal assembly 70 carried on a shouldered recess of the seal support 69 forming a watertight static connection therewith. The extensions of the shafts 60 and 66 are adapted for connection, respectively with agitator 44 and spin basket 28. In this regard, agitator drive shaft 66 has attached on its upper end and secured thereto by cross pin 72 a splined agitator-driver 74 as a portion of the agitate drive shaft means. The driver interfits with a complementary socket or bottom opening 76 in the underside of agitator 44 and transmits the oscillations of the agitator shaft 66 to the agitator.

As viewed in FIG. 1, the outer tub bulkhead 78 has its centrally drawn cup or boss 82 provided with an annular flange 84 defining outer tub opening 86 which is in axial alignment with opening 88 in the spin basket 28. Integral with the housing 68 are spider-like radiating arms 92 fastened to the outer tub 26 by bolts 94 threaded in nuts 95 positioned in bulkhead lugs 93. Antifriction bearing 96 supports and journals depending tube portion 98 of the spin shaft 60. A rotating seal 99 is provided on the spin shaft portion 98 and acts as a slinger seal to intercept any water escaping the seal assembly 70 and directs or slings the water outwardly through a discharge passage or slot 97. An outer O-ring cup seal 100 is provied between the boss 82 and the annular cast shoulder 83 of the housing 68. One such seal arrangement is disclosed in U.S. Pat. No. 3,793,854 assigned to the same assignee as the present application.

It will be noted in FIG. 3 that the oscillatable agitate drive shaft 66 has its upper portion concentrically encircled by the spin drive shaft means in the form of the assembly 60 which includes the spin tub support hub member 62 and the lower spin sleeve 98. In this manner the spin tub sleeve 98 is rotatably journaled concentrically about the agitator shaft 66 by bearing means in the form of an upper 102 and lower 104 sleeve bearing.

The drive mechanism 50 includes a pair of upper and lower concentrically arranged vertically spaced driven pulleys 152 and 154 respectively, supported on the lower portion of the agitate shaft 66 such that the driven pulleys are freely rotatable thereon. The upper 152 and lower 154 pulleys are shown as mirror images with the upper pulley 152 including integral bearing hub 156 as shown in FIG. 2, such that the pulley 152 is rotatably mounted relative to the agitate shaft 66 on a bearing 162, the inner race of which is secured to housing 68. In a similar manner lower pulley 154 is rotatably mounted relative to agitate shaft 66 on a bearing 164 in integral bearing hub 166. It will be noted that pulleys 152 and 154 are rotably carried on the agitate shaft 66 in fixed horizontal respective planes relative to the agitator 44 and the spin tub 28.

As best shown in FIG. 2, the reversing clutch means 170 of the present invention includes complementary upper driven plate 172 and lower driven plate 173 which are integrally formed in concentric fashion on the hub portions 156 and 166 respectively, of the upper and lower pulleys. The clutch plates 172 and 173 have concentric opposed peripheral rings 174 and 175 formed therein with notches 176 and 177 shown in 180° diametrically opposed relation. A radial transfer arm 180 includes an outer roller 200 freely rotatable on a roller pin 201 threadedly received at 202 in axial bore 203 of arm 180 pivotally secured to the agitator shaft 66 intermediate the clutch plates 172 and 173 with the transfer arm proximal bifurcated end pivotally secured about a horizontal axis such that its laterally spaced disc-like inner ends 182 and 184 are positioned on either side of shaft 66.

Figure 6:
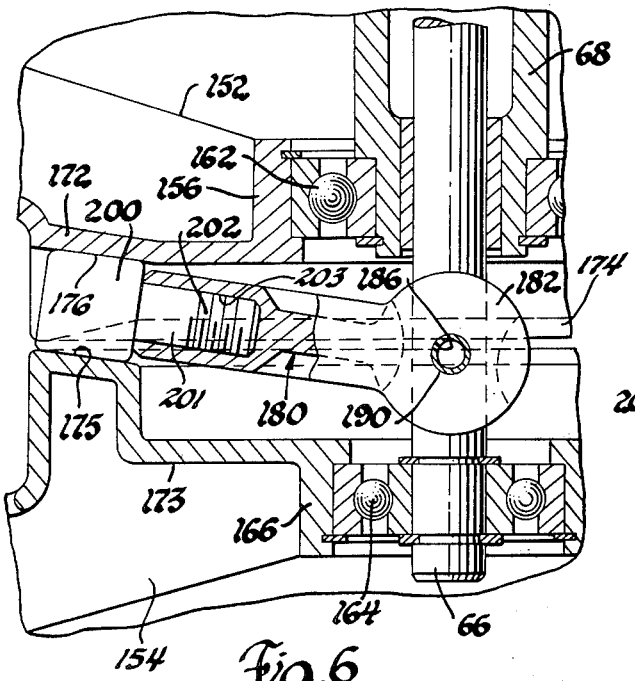
FIG. 6 is an enlarged fragmentary sectional view of the transfer arm in its upper pulley drive position.
Figure 7:
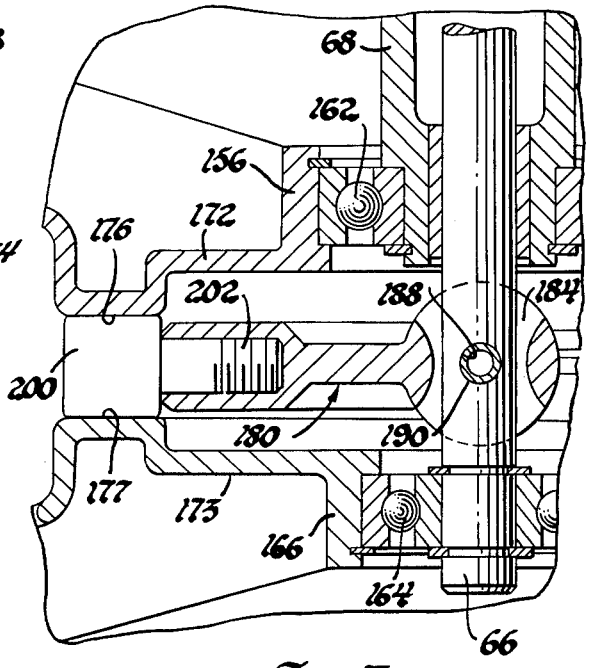
FIG. 7 is a view similar to FIG. 6 with the transfer arm in mid transfer position.

As viewed in FIGS. 6 and 7, aligned apertures 186 and 188 in the discs allow for the reception of a pivot pin 190 extending normal to and passing through the axis of the agitator shaft 66 by means of an aligned bore therein. The upper ring notch 176 is in the form of a downwardly opening one-way drive notch while the lower ring notch 177 is in the form of an upwardly opening one-way drive notch. As seen in FIG. 8, the notches 176 and 177 are complementary, i.e., in mirror image relation with the notches 176 and 177 having first camming portions 192 and 193 respectively, and second capturing portions 194 and 195 respectively.

Figure 4:
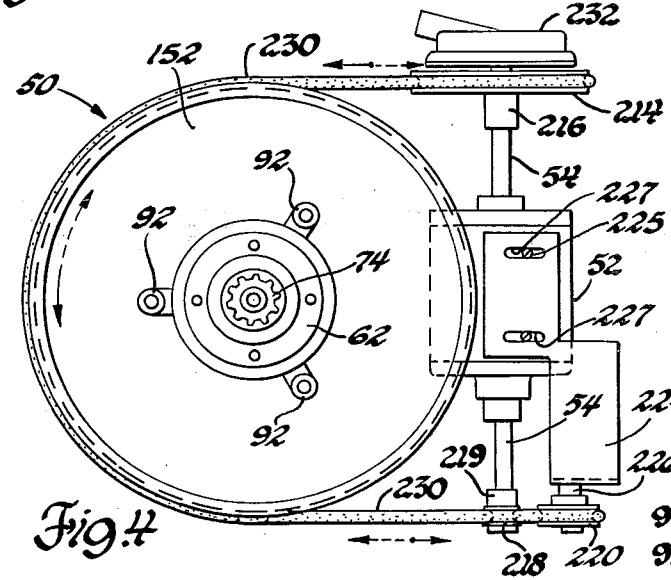
FIG. 4 is an enlarged sectional view, partly in elevation, taken substantially on line 4—4 of FIG. 1.

As best seen in FIGS. 1, 2 and 4, the reversible motor 52 is resiliently supported by an angular support member 210 fixed to the frame of the washer by means of bolts 212. The motor has a spin drive pulley 214 secured to one end of the driven shaft 54 by an overrunning one-way clutch 216. An agitate drive pulley 218 is secured to the opposite end of the shaft by one-way clutch 219. A pair of upper and lower idler pulleys 220 and 222 respectively, are mounted on the agitate drive pulley end of the shaft by means of idler pulley mounting bracket plate 224 by bolts 225 in adjustint slots 227 so as to be in the same vertical plane as the agitate drive pulley 218. The upper idler pulley is mounted on a stub shaft 226 and the lower idler pulley is mounted on a stub shaft 228 which are vertically spaced such that the drive belt means, which is in the form of a single round belt 230, is directed in substantially parallel upper and lower parallel passes as it passes from upper driven pulley 152 to the upper idler 220 and returns from the lower idler 222 to the lower driven pulley 154.

As seen in FIG. 2, the pulley 218 serves as speed reduction pulley of a predetermined diameter which, with the predetermined diameters of the driven pulleys 152 and 154, reduce the rotational speed of the drive shaft 54 from about 1750 R.P.M. to an agitate shaft oscillation of about 80 strokes per minute. It will be noted that the single round drive belt 230 extends in a single pass for encircling the driven pulleys 152 and 154, the spin pulley 214 on one end of the drive shaft to the agitate drive pulley 218 on the opposite ends of the drive shaft and idler pulleys 220 and 222. One end of the drive shaft 54 is drivingly associated with the water pump 232 (FIG. 4) which pumps water from the outer tub 26 when the motor drive shaft 54 is driven in a clockwise manner. Water pump 232 is operative to reverse its direction when the motor 52 reverses and blocks flow of water from outer tub 26.

The overrunning clutches 216 and 219 are operative such that in the washer's agitate mode of operation, represented by solid line arrows in FIGS. 1, 2 and 4 when the motor shaft 54 and driving pulley 218 is rotated in a counterclockwise direction, the spin pulley 214 is free running on the motor drive shaft in the same or counterclockwise direction. The belt 230 also drives the two idler pulleys 220 and 222 in clockwise directions, thereby driving the upper driven pulley 152 in a counterclockwise direction and the lower driven pulley 154 in a clockwise direction at a fixed single speed which in the disclosed embodiment is about 80 R.P.M.

Upon the motor 52 being reversed the drive shaft 54 and drive pulley 214 will rotate in a clockwise direction, as seen by the dashed arrows, causing the drive belt 230 to drive the upper driven pulley 152 in a clockwise spin direction while simultaneously driving the lower pulley 154 in a counterclockwise direction at about 640 R.P.M. Thus, the driven pulleys will be simultaneously driven in opposite directions of rotation by rotation of the drive shaft 54 in either direction and at two different speeds depending upon the direction of rotation of motor 52.

Figure 5:
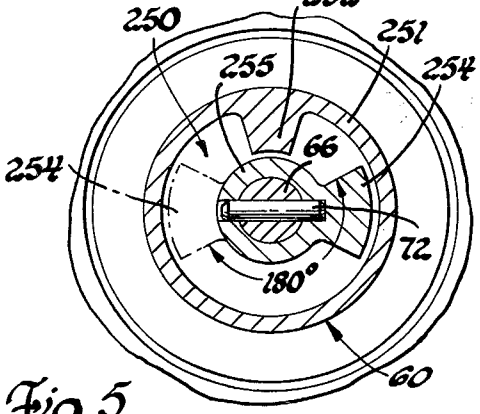
FIG. 5 is an enlarged, fragmentary cross-sectional view of the spin and agitator shaft portions of the washer taken on line 5—5 of FIG. 3.

With reference to FIGS. 3 and 5, coupling means 250 are provided which are operative upon engagement to connect the concentric rotable outer spin shaft 60 and the inner agitate shaft 66 during a spin cycle of the spin basket 28. In the form shown the coupling means 250 function to connect the outer spin shaft assembly 60 upwardly extending sleeve portion 251 and the inner concentric agitate shaft 66 during a spin drying operation. The coupling means 250 include a radial lug member 252, shown integrally formed on the inner wall of the spin shaft sleeve 251, and a driving lug 254 integral with the agitator driver 255. Lug 254 is free to oscillate with the agitate shaft 66 through its agitation arc of 180° without engaging the lug 252. Upon the driving lug 254 engaging the spin shaft drive lug 252 the agitate shaft 66 is coupled to the spin shaft assembly 60 to effect rotation of the spin basket 28. It will be noted that the transverse agitate shaft pin 72 extends through the agitate shaft 66 and the inner agitate driver 255 so that the shaft 60 rotates in unison with the agitate shaft 66.

The functioning of mechanism 50 to produce an angular stroke of about 180 degrees for agitator 44 at a rate of about 90 oscillations per minute can be best understood with reference to FIG. 8. As shown diagrammatically in the upper instant action portion (a) of FIG. 8, the top pulley 152 of mechanism 50 is rotating in a counterclockwise direction as indicated by its solid arrow at about 80 R.P.M., while lower pulley 154 is being rotated in a clockwise direction also at about 80 R.P.M. as indicated by its solid arrow. As will be noted, transfer arm 180 has its roller 200 contained in notch 177 of lower pulley 154 and is being rotated therewith while also being wedged by cam surface 193 of the notch 177 against the constraining ring portion 174 of upper pulley 152. With the pulleys 152 and 154 being rotated as described, power is being expended by motor 52 through belt 230 and pulley 154 to move the transfer arm 180 and connected agitator shaft 66 and agitator drive hub 51 to drive the agitator 44 in a clockwise direction and do work on clothes placed in tub 28 by moving them relative to the tub during a normal wash cycle of washing machine 10. During this instant of action, while the transfer arm 180 is captured and being moved to do work in a clockwise direction by notch 177, the sloped cam surface 193 is producing a force on the transfer arm 180 with an upwardly directed component of force (arrow 181) which causes roller 200 to ride in contact with the constraining ring surface 174 of upper pulley 152. It is apparent from this drawing view that if pulley 152 and its constraining ring surface 174 were not present the transfer arm 180 would pivot upwardly about pivot pin 190 and escape from notch 177 of lower pulley 154 and thus decouple itself and the agitator shaft 66 from a driving connection with pulley 154.

In the mid-position instant action portion (b) of FIG. 8, a fraction of a second has passed and pulleys 152 and 154 have been rotated about 10° by belt 230 so as to bring their respective drive notches 176 and 177 just past vertical alignment with one another. As noted by force component arrow 181, cam surface 193 of notch 177 is still producing an upwardly directed component of force on transfer arm 180, which at the same instant of time is no longer prevented from moving upward by constraining ring surface 174 of upper pulley 152. Consequently, the transfer arm 180 is now being forced upward by cam surface 193 into the notch 176 of upper pulley 152.

As shown in the lower instant action portion (c) of FIG. 8, transfer arm 180 has now been fully captured by notch 176 of upper pulley 152 and its direction of rotation has been reversed to that of a counterclockwise direction so as to do work in moving clothes placed in tub 28 relative thereto by the action of agitator 44 driven by agitator shaft 66 and agitator drive hub 74.

Thus it will be apparent, with reference to the instant action portions (a), (b) and (c) of FIG. 8, that transfer arm 180 has been transferred from a driving relationship with lower pulley 154 to a driving relationship with upper pulley 152 as their respective notches 177 and 176 come into vertical alignment with each other. However, it should be noted that such a transfer can occur only when pulley 152 is rotating in a counterclockwise direction and pulley 154 is rotating in a clockwise direction. It is also obvious that because of the symmetry of the forces produced upon transfer arm 180 by cam surfaces 192 and 193 of pulleys 154 and 156 that the arm 180 will be transferred from upper pulley notch 176 back to lower pulley notch 177 the next time the two notches come into essentially vertical alignment. In the disclosed form this will occur with every 180 degree rotation of each of the pulleys, as they are driven at the same rotational speed by belt 230, but in opposite directions. It will be appreciated that a transfer and change of direction of rotation of transfer arm 180 will occur twice for every revolution of pulleys 152 and 154 which are being driven at about 80 R.P.M. As a result, the above described arrangement will cause transfer arm 180 and associated shaft 66, agitator drive hub 74 and agitator 44 to oscillate in a horizontal plane at a rate of about 80 times per minute and through an arc of about 180 degrees to produce the desired agitation to clean clothes placed in a cleaning solution contained in the spin basket 28.

To produce the desired spinning of the tub 28 in outer container 26 and extract cleaning and rinsing fluids from clothes placed therein, the timer 17 causes motor 52 to stop and then to reverse its direction of rotation. As a result, clutch 216 drives pulley 214 at 1750 R.P.M. and belt 230 drives pulleys 152 and 154 at about 640 R.P.M. However, as shown in FIG. 9, pulley 152 is now being rotated in a clockwise direction and pulley 154 is being rotated in a counterclockwise direction. As is shown in the drawings, surface 194 of notch 176 and surface 195 of notch 177 are perpendicular to the plane of rotation of pulleys 152 and 154. Consequently, these surfaces can produce only a force in this same horizontal plane on transfer arm 180. As a result there is no force from transfer arm 180 against ring surface 175 of lower pulley 154 and arm 180 remains captured in notch 176 of upper pulley 152 as it moves past notch 177 of lower pulley 154 and arm 180 rotates continuously with pulley 152 to rotate agitator shaft 66, agitator drive hub 51, spin drive shaft assembly 60 and tub 28 in a clockwise direction at about 640 R.P.M. and aid in extracting fluids from the clothes placed therein. The driving arrangement between agitator drive hub 51 and spin drive shaft assembly 60, as shown in FIG. 8, has been described previously.

It is obvious to those skilled in the art that had transfer arm 180 been in notch 177 of lower pulley 154 when motor 52 was reversed, it would have remained in the notch 177 by virtue of the surface 195 being perpendicular to the plane of rotation and the tub 28 would have been caused to rotate in a clockwise direction. Either direction of rotation of tub 28 will produce the proper centrifuging force on the fluids retained by clothes therein. However, if desired, a means for biasing the transfer arm 180 toward one pulley, such as by spring 181 shown in FIG. 2, may be used to assure a single direction of spin for tub 28. A clockwise direction of rotation is produced when the spring 181 biases the transfer arm 180 lightly upward toward pulley 152.

While the embodiment of the present invention as herein disclosed constitutes a preferred form it is to be understood that other forms might be adopted.

I claim:

1. In a washing machine, a tub, an agitator in said tub, means for rotably supporting said tub, means for rotating said tub, agitate shaft means enclosed by a portion of said rotating means, a power drive shaft, and power transmitting means drivingly connecting said drive shaft to said agitator shaft, means for oscillating said agitator, said power transmitting means comprising upper and lower concentrically arranged driven pulleys rotatably carried in fixed respective planes with respect to said agitator shaft means, drive belt means encircling said driven pulleys and opposite ends of said drive shaft, whereby said driven pulleys will be simultaneously driven by opposite directions of rotation by rotation of said drive shaft, reversible clutch means between said driven pulleys for drivingly rotating said agitate shaft means relative to either of said driven pulleys, said clutch means including a radial transfer arm pivotally secured to said agitator shaft means intermediate the driven pulleys for pivotal movement about a horizontal axis through the axis of said agitate shaft means, said upper driven pulley having a downwardly opening drive notch formed therein, said lower driven pulley having an upwardly opening drive notch formed therein, said notches each having cam portions in mirror image relation upon being rotated into substantial vertically opposed alignment, whereby said lower pulley notch being operative to engage said transfer arm to effect a driving relationship between said drive shaft and said lower pulley and rotate said agitator shaft in a first direction through a predetermined angular stroke, said clutch means operative upon said lower pulley being rotated through said stroke positioning said lower notch in substantial vertically opposed alignment with said upper pulley notch, such that said transfer arm is free to move from its engaged position along said lower pulley notch cam portion under the dislodging force of the rotation of said lower pulley, whereby said transfer arm is pivoted upwardly and engaged by said upper pulley notch to effect a driving relationship between said drive shaft and said upper pulley and rotate said agitator shaft in a reverse direction through a predetermined angular stroke.

2. In a washing machine, a tub, an agitator in said tub, means for rotably supporting said tub, spin shaft means for rotating said tub, agitate shaft means concentrically encircled by a portion of said spin shaftmeans, a double-ended reversible power drive shaft, and power transmitting means drivingly connecting said drive shaft to said tub spin shaft means for rotating said tub and to said agitator shaft means for oscillating said agitator, said power transmitting means comprising upper and lower concentrically arranged driven pulleys rotatably carried in fixed respective planes with respect to said agitator shaft means and said tub shaft means, drive belt means encircling said driven pulleys and opposite ends of said drive shaft, whereby said driven pulleys will be simultaneously driven in first opposite directions of rotation by rotation of said drive shaft in a first direction, reversible clutch means between said driven pulleys for drivingly rotating said agitate shaft means relative to either of said driven pulleys, coupling means operative to couple said agitate shaft means to said spin shaft means upon said agitate shaft being rotated through a predetermined arc, said coupling means being inoperative when said shaft means is oscillated through a predetermined stroke less than said arc, said clutch means including a radial transfer arm pivotally secured to said agitator shaft means intermediate the driven pulleys for pivotal movement about a horizontal axis through the axis of said agitate shaft means, said upper driven pulley having a downwardly opening drive notch formed therein, said lower driven pulley having an upwardly opening drive notch formed therein, said notches each having cam portions in mirror image relation upon being rotated into substantial vertically opposed alignment, whereby said lower pulley notch being operative to engage said transfer arm to effect a driving relationship between said drive shaft and said lower pulley and rotate said agitator shaft in a first direction through a predetermined angular stroke, said clutch means operative upon said lower pulley being rotated through a said stroke positioning said lower notch in substantial vertically opposed alignment with said upper pulley notch, such that said transfer arm is free to move from its engaged position along said lower pulley notch cam portion under the dislodging force of the rotation of said lower pulley, whereby said transfer arm is pivoted upwardly and engaged by said upper pulley notch to effect a driving relationship between said drive shaft and said upper pulley and rotate said agitator shaft in a reverse direction through a predetermined angular stroke, and biasing means operative to urge said transfer arm follower means into one of said pulley notches, whereby upon a stoppage of rotation of said drive shaft causing said transfer arm under direction of said biasing means to be captured by said one of said pulley notches, and whereby upon reversal of said drive shaft and belt travel for rotation in a second direction said driven pulleys will be simultaneously driven in opposite directions of rotation by said drive shaft, whereby the rotation of said driven pulleys in said second direction effecting spin rotation of said tub through said spin shaft means and said coupling means by rotating said agitator shaft means.

3. In a washing machine, a tub, an agitator in said tub, means for rotably supporting said tub, spin shaft means for rotating said tub, agitate shaft means concentrically encircled by a portion of said spin shaft means, a double-ended reversible power drive shaft, and power transmitting means drivingly connecting said drive shaft to said tub spin shaft means for rotating said tub and to said agitator shaft means for oscillating said agitator, said power transmitting means comprising upper and lower concentrically arranged driven pulleys rotatably carried in fixed respective planes with respect to said agitator shaft means and said tub shaft means, drive belt means encircling said driven pulleys and opposite ends of said drive shaft, whereby said driven pulleys will be simultaneously driven in first opposite directions of rotation by rotation of said drive shaft in a first direction, reversible clutch means between said driven pulleys for drivingly rotating said agitate shaft means relative to either of said driven pulleys, coupling means operative to couple said agitate shaft means to said spin shaft means upon said agitate shaft being rotated through a predetermined arc, said coupling means being inoperative when said shaft means is oscillated through a predetermined stroke less than said arc, said clutch means including a radial transfer arm pivotally secured to said agitator shaft means intermediate the driven pulleys for pivotal movement about a horizontal axis through the axis of said agitate shaft means, said transfer arm having follower means adjacent its outer end, said upper driven pulley having a downwardly opening drive notch formed therein, said lower driven pulley having an upwardly opening drive notch formed therein, said notches each having cam portions in mirror image relation upon being rotated into substantial vertically opposed alignment, whereby said lower pulley notch being operative to engage said transfer arm follower means to effect a driving relationship between said drive shaft and said lower pulley and rotate said agitator shaft in a first direction through a predetermined angular stroke, said clutch means operative upon said lower pulley being rotated through said stroke positioning said lower notch in substantial vertically opposed alignment with said upper pulley notch, such that said transfer arm follower means is free to move from its engaged position along said lower pulley notch cam portion under the dislodging force of the rotation of said lower pulley, whereby said follower means is pivoted upwardly and engaged by said upper pulley notch to effect a driving relationship between said drive shaft and said upper pulley and rotate said agitator shaft in a reverse direction through a predetermined angular stroke, and biasing means operative to urge said transfer arm follower means into one of said pulley notches, whereby upon a stoppage of rotation of said drive shaft causing said transfer arm follower means under direction of said biasing means to be captured by said one of said pulley notches, and whereby upon reversal of said drive shaft and belt travel for rotation in a second direction said driven pulleys will be simultaneously driven in opposite directions of rotation by said drive shaft, whereby the rotation of said driven pulleys in said second direction effecting spin rotation of said tub through said spin shaft means and said coupling means by rotating said agitator shaft means.

* * * * *